US007365760B2

(12) United States Patent
Katsuma et al.

(10) Patent No.: US 7,365,760 B2
(45) Date of Patent: Apr. 29, 2008

(54) RECORDING HEAD WITH TEMPERATURE SENSOR AND PRINTER WITH THE RECORDING HEAD

(75) Inventors: Nobuo Katsuma, Saitama (JP); Tomoyoshi Nishimura, Saitama (JP)

(73) Assignee: FUJIFILM Corporation, Tokyo (JP)

( * ) Notice: Subject to any disclaimer, the term of this patent is extended or adjusted under 35 U.S.C. 154(b) by 229 days.

(21) Appl. No.: 11/144,012

(22) Filed: Jun. 3, 2005

(65) Prior Publication Data

US 2005/0270359 A1 Dec. 8, 2005

(30) Foreign Application Priority Data

Jun. 3, 2004 (JP) ..... 2004-166279
Jul. 6, 2004 (JP) ..... 2004-199430

(51) Int. Cl.
*B41J 2/335* (2006.01)

(52) U.S. Cl. ..... 347/200

(58) Field of Classification Search ..... 347/200, 347/208–210

See application file for complete search history.

(56) References Cited

U.S. PATENT DOCUMENTS 5,335,002 A * 8/1994 Nagahata et al. ..... 347/209
5,469,068 A 11/1995 Katsuma
5,959,651 A * 9/1999 Nagahata et al. ..... 347/200

FOREIGN PATENT DOCUMENTS

| | | | |
|---|---|---|---|
| JP | 62-170366 | A | 7/1987 |
| JP | 4-17798 | B2 | 3/1992 |
| JP | 2627348 | B2 | 4/1997 |
| JP | 3389419 | B2 | 1/2003 |

* cited by examiner

*Primary Examiner*—Huan Tran
(74) *Attorney, Agent, or Firm*—Sughrue Mion, PLLC

(57) ABSTRACT

A recording head is provided with an element substrate and a circuit board fixed to a head substrate having heat radiation property. Plural heating elements are formed linearly in the element substrate, and plural driver ICs are attached to the element substrate. A temperature sensor is disposed between the driver ICs. The temperature sensor measures average temperature of the plural heating elements, and adjusts a heat quantity of each heating element in accordance with the average temperature. In the preferred embodiment, the plural temperature sensors and a heating element array are arranged on both sides of the element substrate such that the plural temperature sensors are disposed underneath the heating element array. The plural temperature sensors are accommodated in a concave portion of the head substrate.

9 Claims, 7 Drawing Sheets

RECORDING HEAD WITH TEMPERATURE SENSOR AND PRINTER WITH THE RECORDING HEAD

BACKGROUND OF THE INVENTION

1. Field of the Invention

The present invention relates to a recording head with a temperature sensor, and a printer with the recording head.

2. Description of the Prior Arts

As a printer for recording an image on a recording material by using a recording head, widely known is a color direct thermal printer to make a full-color print on a color thermal recording paper in which thermosensitive coloring layers developing cyan, magenta and yellow colors are overlaid on a support one by one. In the color direct thermal printer, three-color images are recorded in frame-sequential fashion by a thermal head while the color thermal recording paper is fed. The thermal head is provided with a heating element array in which plural heating elements are arranged linearly.

In prior art color thermal printers, driving energy to the heating elements is adjusted in accordance with head temperature measured by a temperature sensor attached to a head substrate of the thermal head, in order to prevent density unevenness caused by accumulation of heat in the heating elements.

The driving energy is preferably corrected based on temperature near the heating element array. However, in prior art thermal heads, the temperature sensor is attached to the head substrate, and the heating energy from the heating element array is transmitted to the temperature sensor through the head substrate and an element substrate having plural driver ICs for driving the heating element selectively. Therefore, there has been a problem that the temperature measured by the temperature sensor is different from the actual temperature near the heating element array.

In order to solve the above problem, in a thermal line printer described in U.S. Pat. No. 2,627,348 estimates the temperature near the heating element array based on arithmetic expressions using the measurement result of the temperature sensor.

However, in the above thermal line printer, much calculation is required to estimate the temperature near the heating element array, and, it is necessary to provide an arithmetic circuit for such calculation. This results in requiring a certain amount of time for the arithmetic processing, and to make matters worse, increasing the manufacturing cost. In addition, it is difficult to obtain parameters for the arithmetic expressions which contribute to prevent the density unevenness.

There are various techniques for mounting the temperature sensor. For example, the thermal printer described in Japanese Patent Laid-Open Publications No. 62-170366 has a thermistor, as the temperature sensor, in the rear surface of a ceramic substrate as the element substrate. However, any concrete wiring methods are not mentioned, and this technique is somewhat impractical.

In a thermal head in Japanese Published Examined Application No. 4-17798, the thermistor is disposed around a driver IC array in the ceramic substrate. However, the thermistor cannot be attached near the heating element because the platen roller would interfere with the thermistor. Additionally, if the plural thermistors are attached in the main scanning direction, some space should be made to attach them around the driver IC array. Thus, there is a problem that the size of the thermal head becomes unnecessarily large in the main scanning direction.

In the thermal head described in U.S. Pat. No. 3,389,419, the thermistor and the driver IC are put in a concave portion formed in the ceramic substrate. This configuration prevents the platen roller from interfering with the thermistor but the concave portion is hard to form in the element substrate, so that the manufacturing cost is increased. In addition, the problem about the size of thermal head in Japanese Patent Laid-Open Publications No. 4-17798 cannot be solved.

SUMMARY OF THE INVENTION

A primary object of the present invention is to provide a recording head which can measure temperature near a heating element correctly.

Another object of the present invention is to provide a recording head which enables to mount plural temperature sensors at low cost.

A further object of the present invention is to provide a printer which can make a high-quality print by preventing occurrence of density unevenness due to heat accumulation in a heating element array.

In order to achieve the above and other objects, at least one temperature sensor for measuring temperature near heating elements to adjust a heat quantity of each heating element is attached to an element substrate to which at least one driver IC and the plural heating elements are attached. The element substrate is attached to a head substrate having heat radiation property.

The plural heating elements are arranged linearly along a width direction crosswise to a feeding direction of a recording material. At least one driver IC is a plurality of driver ICs evenly spaced apart in the width direction. The recording head of the present invention is applied to a thermal head of a thermal printer. When one temperature sensor is provided, it is disposed between two driver ICs positioned in the center. When plural temperature sensors are provided, the driver IC and the temperature sensor are disposed alternately.

The temperature is preferably detected not during recording but just before recording. In order to detect the temperature, a capacitor and the temperature sensor are connected in parallel to plural heating elements. The temperature is measured by the following steps: charging the capacitor; discharging the capacitor to a predetermined potential through the temperature sensor; and obtaining resistance value of the temperature sensor, changing in accordance with temperature, based on time taken for discharging. In order to charge and discharge the capacitor, the recording head includes a switch for charging the capacitor and a switching element connected in series with the temperature sensor. The capacitor is charged by turning on the switch, while the capacitor starts to discharge by turning on the switching element.

A recording head of the preferred embodiment of the present invention is provided with plural sensors, a wiring pattern, a circuit pattern, connector, and a head substrate. The plural sensors are disposed on a rear surface of an element substrate, on whose surface plural heating elements are aligned, to measure temperature near the heating element. The wiring pattern is connected to the temperature sensor. The circuit pattern of a control circuit is formed on both surfaces of a circuit board. The connector, placed between circuit board and the element substrate in which plural heating elements are aligned on the surface, electrically connects the wiring pattern and the circuit pattern. The element substrate and the circuit board are abreast attached to the head substrate.

The connector is a flexible printed board. The temperature sensor and the connector are contained in recesses of the head substrate having heat radiation property. The temperature sensor is placed within 10 mm from a point underneath the heating element in a direction crosswise to the direction of the heating elements. An insulating film is applied to a position where rear surfaces of the element substrate and the circuit board contact with the head substrate.

According to the recording head of the present invention, the temperature sensor for measuring the temperature near the heating element is attached to the element substrate in which the plural heating elements are formed and the driver IC for driving the heating elements selectively is mounted. Thereby, the temperature near the heating elements can be measured correctly with a simple structure.

According to a printer of the present invention, the image is recorded on the recording material by use of the above recording head, so that the occurrence of the density unevenness can be prevented, and a high-quality print can be obtained.

Moreover, according to the recording head of the present invention, the plural temperature sensors for measuring the temperature near the heating element are disposed on a rear surface of the element substrate. Additionally, the wiring pattern is formed to connect to these temperature sensors. Moreover, the circuit pattern of the control circuit is formed in the both surfaces of the circuit board. Furthermore, the connector for electrically connecting the wiring pattern and the circuit pattern is disposed between the element substrate and the circuit board. Thereby, the temperature sensor can be mounted in the thermal head at low cost.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
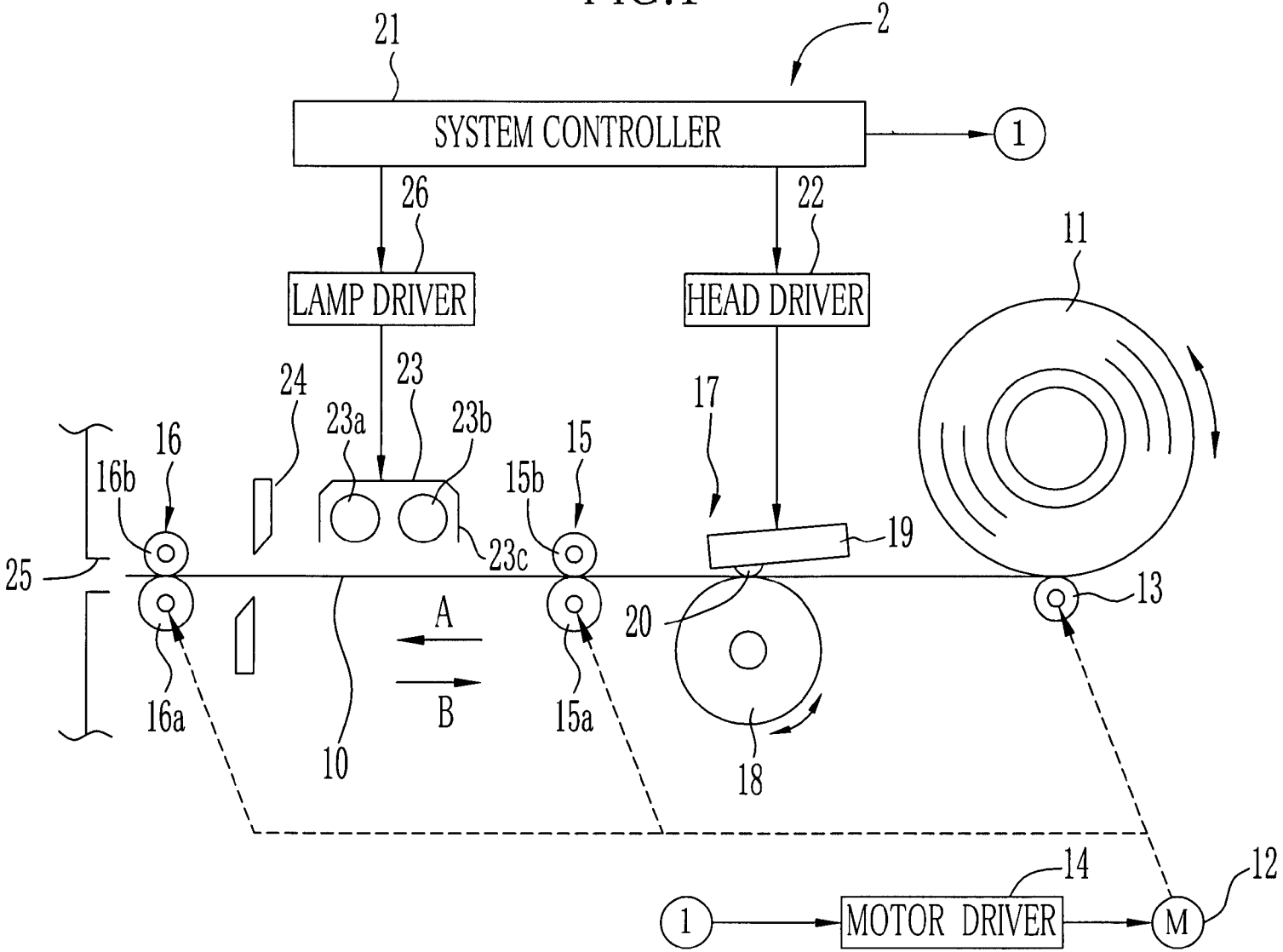
FIG. 1 is a schematic view showing constitution of a color thermal printer of the present invention.

As shown in FIG. 1, a continuous color thermal recording paper (hereinafter referred to as the recording paper) 10 as a recording material is used in a direct color thermal printer 2. The recording paper 10 is wound into a roll shape to be a recording paper roll 11 and loaded in a color thermal printer 2.

The recording paper 10 includes a cyan thermosensitive coloring layer, a magenta thermosensitive coloring layer, a yellow thermosensitive coloring layer, and a protective layer overlaid on a support in sequence. The yellow thermosensitive coloring layer which is the farthest from the support has the highest heat sensitivity and develops the yellow color by application of relatively low heat energy. The cyan thermosensitive coloring layer, which is the closest to the support, has the lowest heat sensitivity and develops the cyan color by application of relatively high heat energy.

The yellow thermosensitive coloring layer loses its coloring ability when near-ultraviolet rays of 420-450 nm are applied thereto. The magenta thermosensitive coloring layer develops the magenta color with heat energy in between for coloring the yellow and cyan thermosensitive coloring layers, and loses its coloring ability when ultra-violet rays of 365-390 nm are applied thereto. Note that a recording paper may have a four layer structure by adding a black thermosensitive coloring layer.

A supply roller 13 rotated by a feeding motor 12 is in contact with a peripheral surface of the recording paper roll 11. The feeding motor 12 is a stepping motor driven by a driving pulse inputted from a motor driver 14. When the supply roller 13 rotates in a counter clockwise direction, the recording paper roll 11 rotates in a clockwise direction to feed the recording paper 10 from the recording paper roll 11. When the supply roller 13 rotates in the clockwise direction, the recording paper roll 11 rotates in the counter clockwise direction to rewind the recording paper 10 to the recording paper roll 11.

The recording paper 10 from the recording paper roll 11 is fed into a feeding path disposed in a horizontal direction. A feed roller pair 15 and a discharge roller pair 16, which nip and feed the recording paper 10, are disposed in the feeding path. These two roller pairs are constituted of capstan rollers 15*a*, 16*a* to be rotated by the feed motor 12 and pinch rollers 15*b*, 16*b* pushed against the capstan rollers 15*a*, 16*a*. The feed roller pair 15 and the discharge roller pair 16 feed the recording paper 10 reciprocally in an A direction (advancing direction) and in a B direction (withdrawing direction).

Figure 2:
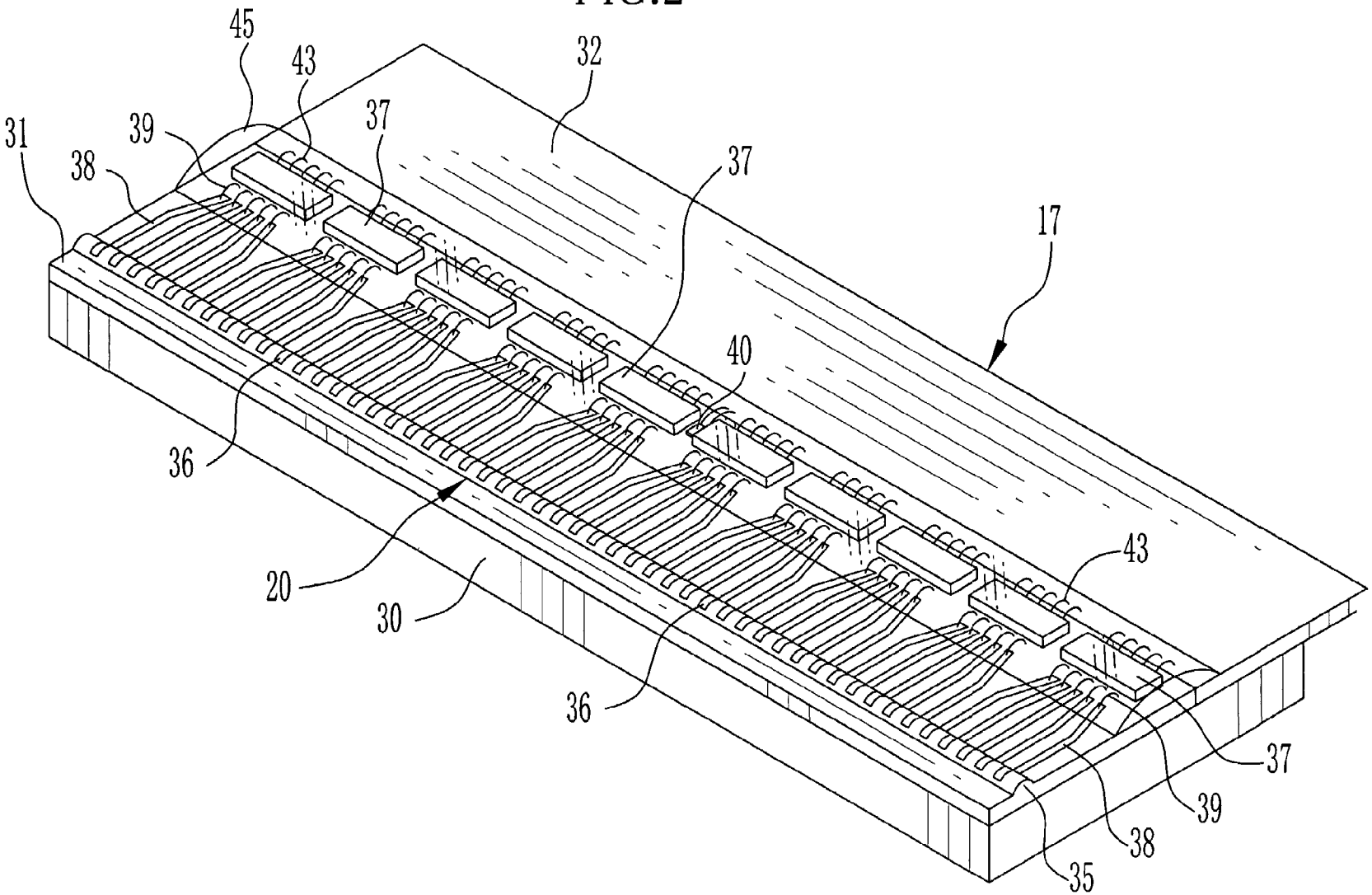
FIG. 2 is a perspective view showing a thermal head in which one temperature sensor is provided on an element substrate.

A thermal head 17 and a platen roller 18, which is disposed below the feeding path so as to face the thermal head 17, are provided between the feed roller 13 and the feed roller pairs 15. In the thermal head 17, a head substrate 30 is positioned on a side facing the recording paper 10. A heating element array 20 in which the heating elements 36 (see. FIG. 2) are arranged linearly is provided on a surface of the head substrate 30. The heating element array 20 is heated based on driving data inputted in a head driver 22 from a system controller 21 to develop each thermosensitive coloring layer of the recording paper 10.

The platen roller 18 supports the recording paper 10 and is rotated by the feeding of the recording paper 10. In addition, the platen roller 18 can move up and down and is biased toward the heating element array 20 by a spring (not shown). When the recording paper 10 is fed or discharged, the platen roller 18 moves down by a shift mechanism (not shown) which is constituted of a cam, a solenoid, and so on, to release the recording paper 10 from the holding of the platen roller 18 and the thermal head 17.

As shown in FIG. 2, the thermal head 17 is constituted of a head substrate 30, a heat element substrate 31, and a circuit board 32. The head substrate 30 is made of such material to radiate heat as aluminum to release the accumulating heat from the heating elements 36. The heat element substrate 31 is made of ceramic, alumina, alumina ceramic, or the like.

A partial glaze layer 35 having an approximately semi-circular-shaped cross section is formed in a front end portion of a top surface of the heat element substrate 31. The plural heating elements 36 constituting the heating element array 20 are provided on the partial glaze layer 35. Driver ICs 37 for driving each heating element 36 are attached to a rear end portion of the top surface of the heat element substrate 31. The driver ICs 37 are connected to the heating elements 36 by a conductive layer 38 and jumper wires 39 which are formed on the heat element substrate 31. A temperature sensor 40 for measuring the temperature near the heating element array 20 is attached between the two adjacent driver ICs 37 at the center of the heat element substrate 31. The temperature sensor 40 may be a thermistor which alters its resistance value in response to temperature.

The circuit board 32 contains a control circuit (not shown) of the thermal head 17, and is disposed behind the heat element substrate 31. The driver ICs 37 and the temperature sensor 40 are connected to the circuit board 32 through the jumper wires 43. The driver ICs 37, the temperature sensor 40, and the jumper wires 39, 43 are covered with a transparent protective resin 45 such that the jumper wires are not broken.

The temperature sensor 40 sends the measurement result of the temperature near the heating element array 20 to the system controller 21 sequentially. The system controller 21 adjusts a heat quantity of the heating element 36 through the head driver 22 in accordance with the measurement result of the temperature sensor 40. When the measured temperature is higher than the predetermined reference value, driving energy (applied voltage or current-carrying time) to the heating element 36 is reduced, while when the measured temperature is lower than the reference value, the driving energy is increased.

In FIG. 1, a fixer 23 is disposed so as to face a recording surface of the recording paper 10 on the downstream side of the feed roller pair 15 in the A direction. A cutter 24 for cutting the recording paper 10 into a predetermined print size is disposed between the fixer 23 and the discharge roller pair 16. An exit opening 25 for discharging a recording sheet with the image recorded is disposed on the downstream side of the discharge roller pair 16 in the A direction.

The fixer 23 is constituted of a yellow fixing light source 23*a* for emitting the near-ultraviolet rays whose light-emitting peak is 420-450 nm to fix the yellow thermosensitive coloring layer, a magenta fixing light source 23*b* for emitting the near-ultraviolet rays whose light-emitting peak is 365-390 nm to fix the magenta thermosensitive coloring layer, and a reflector 22*c* for reflecting the light from the light source 23*a*, 23*b* on the recording paper 10. These light sources 23*a*, 23*b* are driven by a lamp driver 26.

Next, the operation of the direct color thermal printer 2 having the above constitution is explained. When the image recording operation is started, the feed motor 12 rotates in the forward direction to rotate the feed roller 13 in the counter clockwise direction, so that the recording paper 10 from the recording paper roll 11 is advanced in the A direction. The front end of the recording paper 10 advances in the feeding path to be nipped by the feed roller pair 15.

When a leading end of a recording area on the recording paper 10 reaches an image recoding start position, the feed motor 12 temporarily stops rotating. Subsequently, the platen roller 18 is moved up by the shift mechanism to hold the recording paper 10 with the heating element array 20, and then the feed motor 12 rotates again in this state. After that, while the recording paper 10 is advanced in the A direction, the yellow image is recorded line by line on the yellow thermosensitive coloring layer in the recording area by the heating element array 20 which has been heated in accordance with the driving data put into the head driver 22.

The temperature near the heating element array 20 is measured by the temperature sensor 40 before recording the yellow image. The measurement result of the temperature sensor 40 is sent to the system controller 21.

When the measured temperature by the temperature sensor 40 is higher than the predetermined reference value, the driving energy to the heating element 36 is adjusted to reduce by the system controller 21, while when the measured temperature is lower than the reference value, the driving energy is adjusted to increase.

After recording the yellow image, the recording paper 10 is advanced until a rear end of the recording area faces the yellow fixing light source 23*a* of the fixer 23, and then the feed motor 12 stops rotating. At this time, the platen roller 18 is moved down by the shift mechanism to release the holding of the recording paper 10 with the thermal head 17. Subsequently, the yellow fixing light source 23*a* is turned on by the lamp driver 26. The yellow thermosensitive coloring layer with the image recorded is fixed while the recording paper 10 is withdrawn in the B direction by the backward rotation of the feed motor 12.

After the yellow thermosensitive coloring layer has been fixed, the recording paper 10 is advanced until the leading end of the recording area faces the heating element array 20, and then the feed motor 12 stops rotating. As with the yellow image recording, the platen roller 18 is moved up by the shift mechanism to hold the recording paper 10 with the heating element array 20, and the feed motor 12 rotates again in this state. After that, while advancing the recording paper 10 in the A direction, the magenta image is recorded on the magenta thermosensitive coloring layer in the recording area. In addition, as with the yellow image recording, the temperature near the heating element array 20 is measured by the temperature sensor 40 just before the recording. When recording the image, the driving of the heating element 36 is controlled by the system controller 21.

After recording the magenta image, the recording paper 10 is advanced until the rear end of the recording area faces the magenta fixing light source 23*b* of the fixer 23, and then the feed motor 12 stops rotating. Subsequently, as with the yellow image fixing, the magenta fixing light source 23*b* is turned on by the lamp driver 26. The magenta thermosensitive coloring layer with the image recorded is fixed while the recording paper 10 is withdrawn in the B direction by the backward rotation of the feed motor 12.

After the magenta thermosensitive coloring layer has been fixed, the recording paper 10 is advanced until the leading end of the recording area faces the heating element array 20, and the feed motor 12 stops rotating. As with the yellow and magenta image recording, both the temperature measurement and the recording of the cyan image are performed.

The recording paper 10 with the cyan image recorded is advanced in the A direction by the feed roller pair 15, and then discharged from the exit opening 25 by the discharge roller pair 16 after being cut into the predetermined print size by the cutter 24.

As above mentioned, the temperature sensor 40 is attached to the heat element substrate 31 having the heating element array 20. Since the heating energy of the heating element 36 is adjusted in accordance with the temperature measurement result of the temperature sensor 40, the temperature near the heating element array 20 can be measured correctly with a simple structure. Thereby, the density unevenness hardly occurs, and the high-quality print can be obtained.

Figure 3:
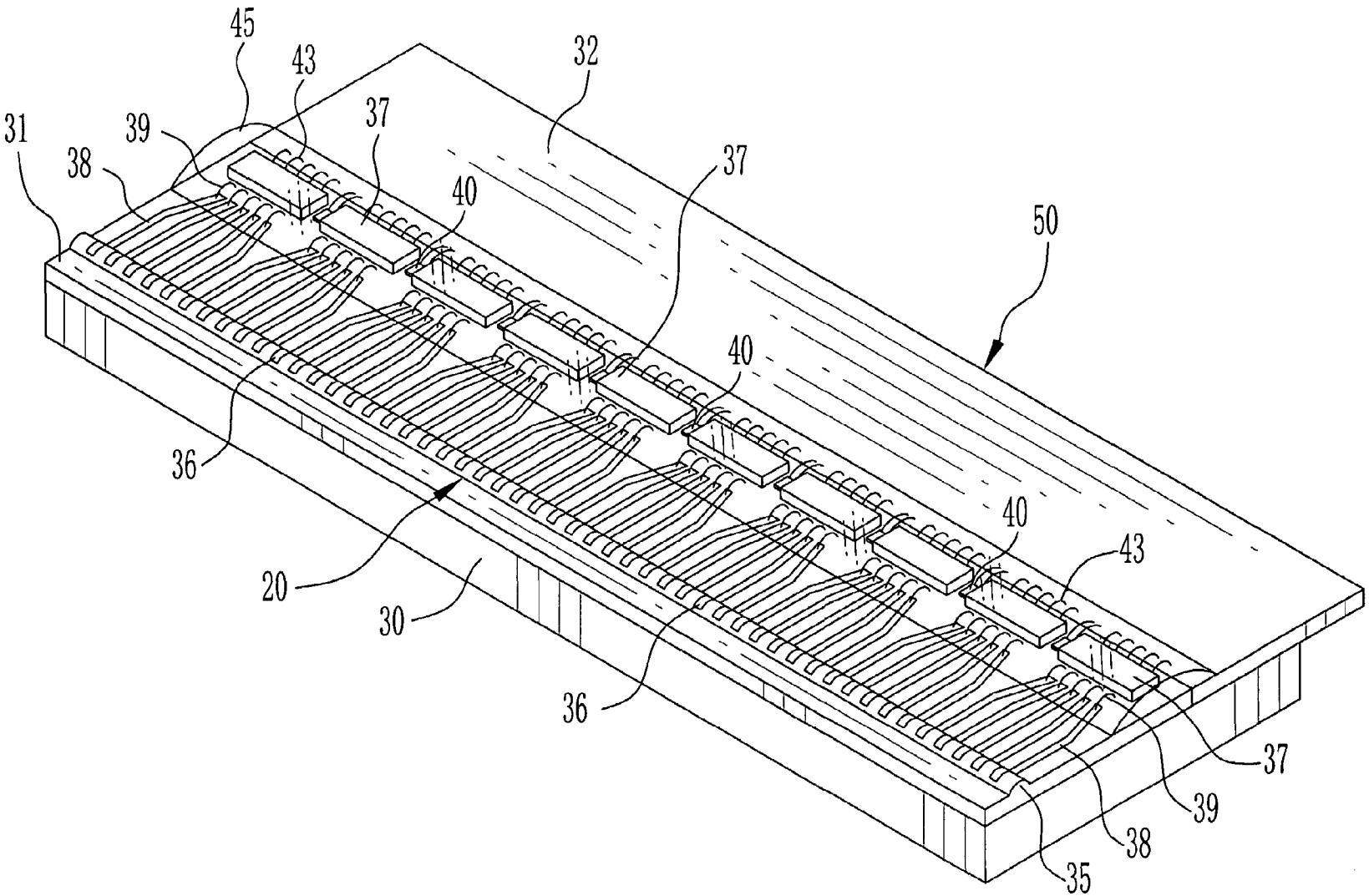
FIG. 3 is a perspective view showing a thermal head in which plural temperature sensors are provided on the element substrate.

In the above embodiment, one temperature sensor 40 is attached to the center of the heat element substrate 31. However, plural temperature sensors 40 may be disposed as a thermal head 50 shown in FIG. 3. In FIG. 3, each of the temperature sensors 40 is disposed between the two adjacent driver ICs 37. Temperature distribution near the heating element array 20 in the main scanning direction crosswise to the feeding direction of the recording paper 10 is obtained to adjust the heating energy of the heating element 36 by the system controller 21. Thereby, the heat of the heating element 36 can be controlled more minutely, and a higher-quality print can be obtained.

Although the temperature sensor 40, together with the driver IC 37 and so forth, is covered with the protective resin 45 in the above embodiment, the temperature sensor 40 may not be covered in order to derive a faster response characteristic from the temperature sensor 40.

Figure 4:
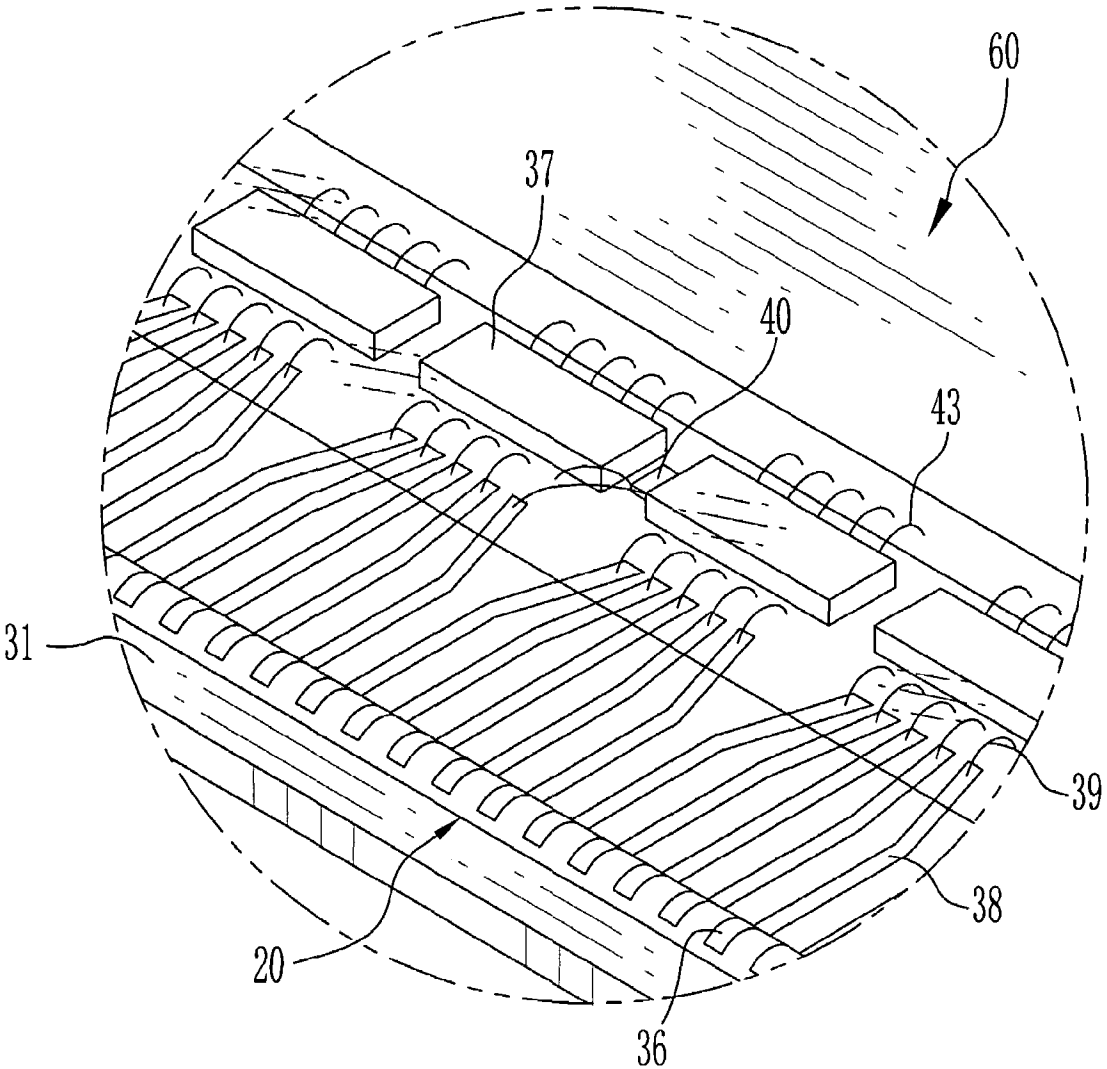
FIG. 4 is an enlarged view of a relevant portion of the thermal head in which a heating element and a temperature sensor are electrically connected in parallel with each other.
Figure 5:
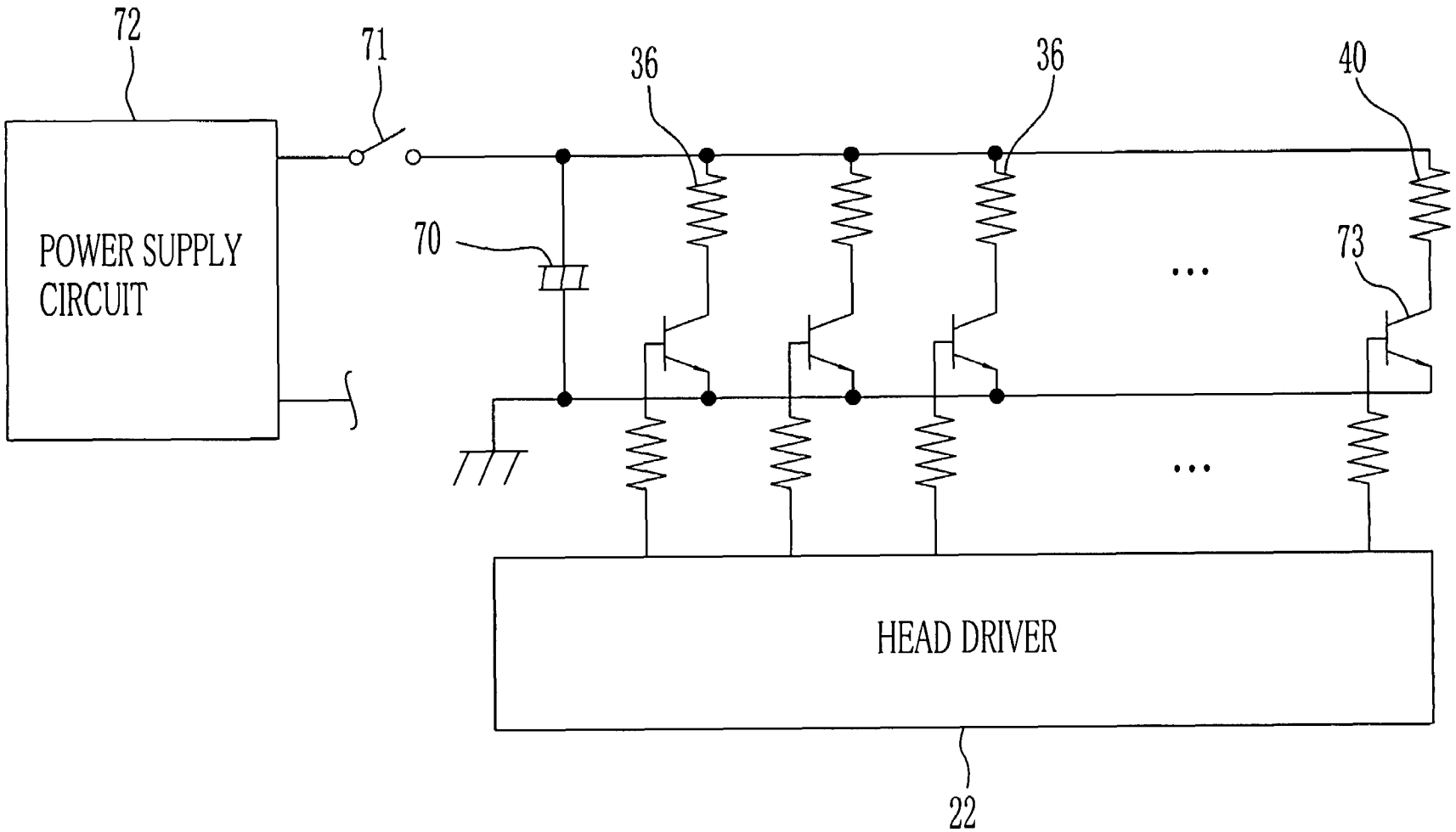
FIG. 5 is an electric circuit diagram of the thermal head shown in FIG. 4.

Additionally, in the above embodiment, the jumper wires 43 from the temperature sensor 40 are directly connected to the circuit board 32. However, the heating element 36 and the temperature sensor 40 may be electrically connected in parallel by connecting one end of the temperature sensor 40 to the conductive layer 38, while connecting the other end to the driver IC 37 as a thermal head 60 shown in FIG. 4. In this case, as shown in FIG. 5, the temperature sensor (thermistor) 40 and the heating elements 36 are electrically connected to a capacitor 70 in parallel. The capacitor 70 is charged by a power circuit 72 with a switch 71 turned on. After that, the switch 71 is turned off and a transistor 73 is turned on. Connected to the temperature sensor 40, the transistor 73 allows the capacitor 70 to discharge the electric charge to the temperature sensor 40. Subsequently, time taken for the capacitor 70 to reach a predetermined potential is measured. The temperature may be obtained from the resistance value of the temperature sensor 40, which is calculated based on the time measurement result. Thereby, the structure of the prior art thermal head can be used effectively without adding a dedicated circuit for obtaining the measurement result of the temperature sensor 40. This technique is explained in detail in U.S. Pat. No. 5,469,068 (Japanese Patent Laid-Open Publication No. 6-79897).

Figure 6:
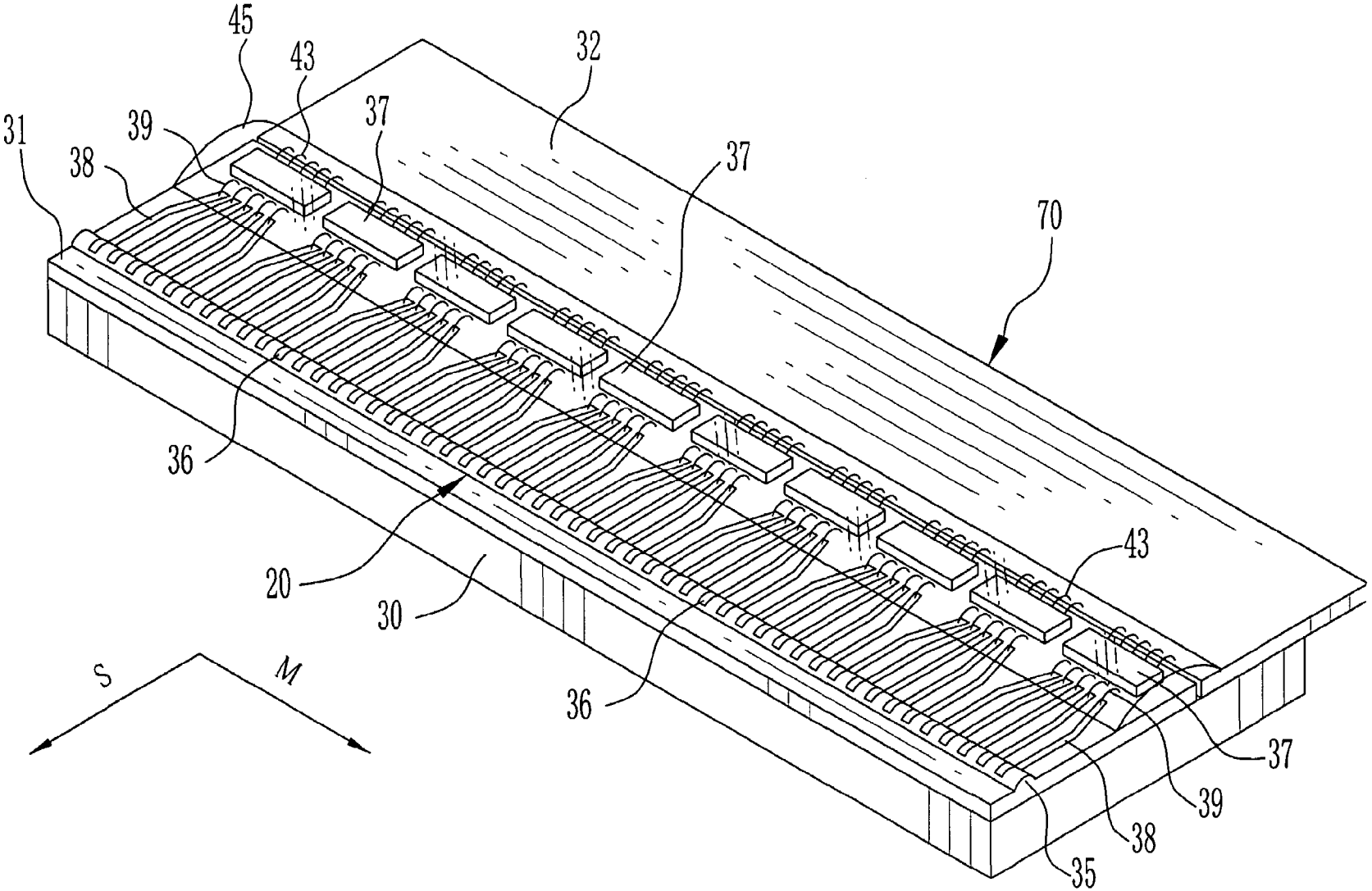
FIG. 6 is a perspective view showing a thermal head in which plural temperature sensors are arranged between a head substrate and the element substrate.
Figure 7:
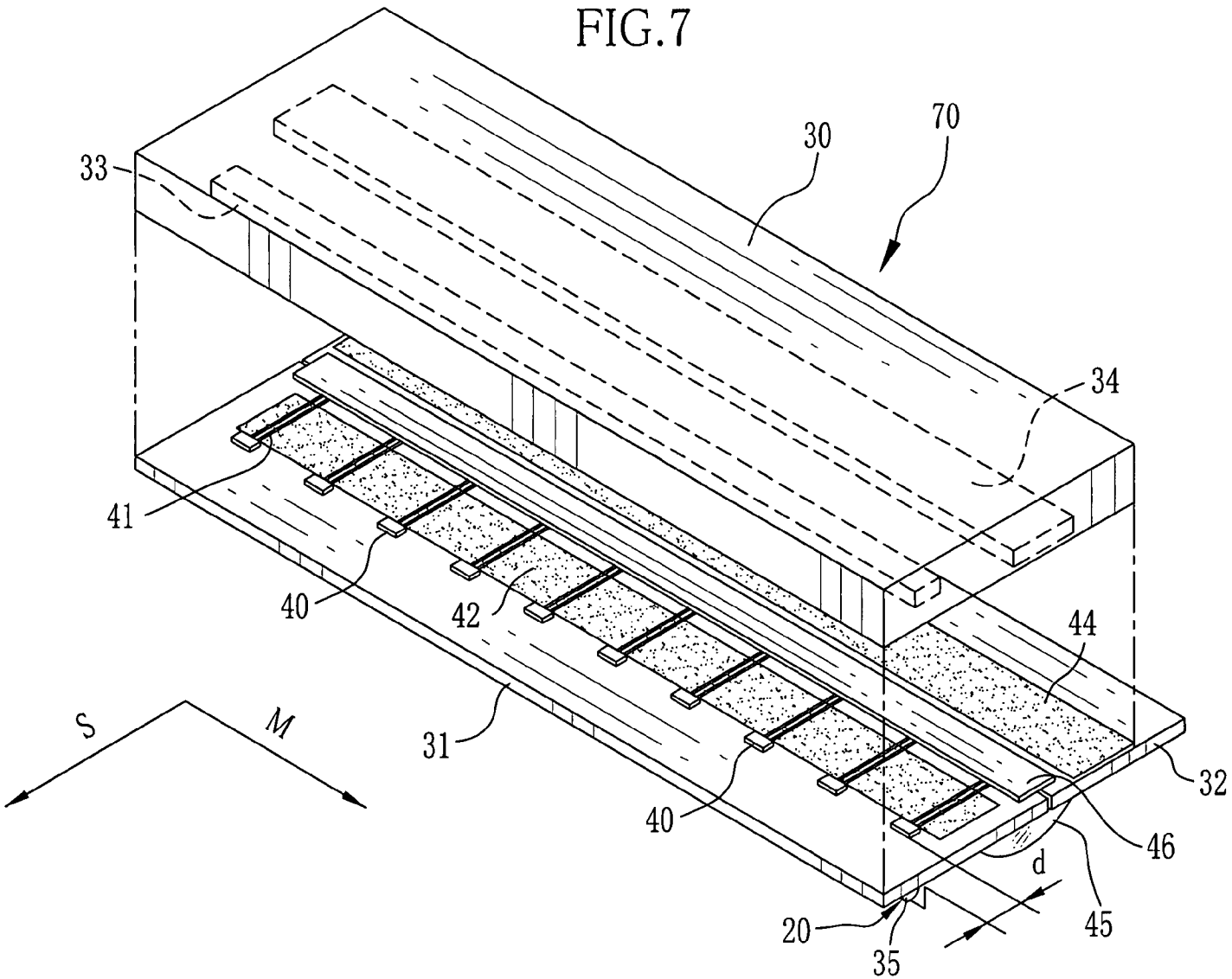
FIG. 7 is an exploded perspective view showing the thermal head shown in FIG. 6.

FIGS. 6 and 7 show an embodiment in which the temperature sensors are disposed between the element substrate and the head substrate. Note that, the same number is given to each element used in common with the foregoing embodiment. As shown in FIG. 6, the heat element substrate 31 and the circuit board 32 are fixed to the head substrate 30 of the thermal head 70 by using an adhesive agent, a two-sided adhesive tape, or the like.

In FIG. 7, concave portions 33, 34 for accommodating the temperature sensors 40 and the flexible printed board 46 are formed in the head substrate 30. Note that, the concave portions 33, 34 may not have a channel-shaped cross section, but have a circular-arc shaped cross section.

The plural temperature sensors 40 for measuring the temperature near the heating element array 20 are evenly spaced apart on a front end portion of a rear surface of the heat element substrate 31. Wiring patterns 41 connecting to these temperature sensors 40 are formed on the heat element substrate 31. Each of the temperature sensors 40 is placed such that a distance d, from the point underneath the heating element array 20 to the temperature sensors 40 in a sub scanning direction (S direction), falls within 10 mm.

An insulating layer 42 such as resist is applied to a position where the rear surface of the heat element substrate 31 and the head substrate 30 are contacted with each other. Thereby, it is possible to prevent the wiring pattern 41 from contacting with the aluminum head substrate 30 to be short-circuited.

An insulating layer 44 is applied to a portion where the rear surface of the circuit board 32 and the head substrate 30 are contacted with each other. The flexible printed board 46 is attached between the heat element substrate 31 and the circuit board 32 for the purpose of electrically connecting the wiring pattern 41 and a circuit pattern of the control circuit (not shown).

As above mentioned, the temperature sensors 40 are disposed between the heat element substrate 31 and the head substrate 30. Therefore, even placed near the heating element array 20, the temperature sensors 40 do not contact the platen roller 18 to cause some printing troubles. Additionally, it is unnecessarily to enlarge the recording head in the main scanning direction for the purpose of mounting the temperature sensor in the driver IC array.

Additionally, the concave portions 33, 34 are formed in the head substrate 30 to accommodate the temperature sensor 40 and the flexible printed board 46. Therefore, the manufacturing cost can be reduced in comparison with forming the concave portions in the hard-to-process heat element substrate 31 to embed the driver IC and the temperature sensor.

Moreover, the temperature sensor 40 is placed such that the distance d, from the point underneath the heating element array 20 to the temperature sensor 40 in the S direction, falls within 10 mm. The temperature near the heating element array 20 can thereby be surely measured.

If one temperature sensor is disposed as close to the heating element array, the output of the temperature sensor is influenced by the heating energy of the heating elements nearby. For instance, when only one temperature sensor 40 is disposed in the center of the heating element array, recording an image data of black only in the center will cause a high output of the temperature sensor 40, even though the other area in the M direction is low in temperature. As a result, the difference between the actual temperature and the detected temperature becomes large, so that the density unevenness cannot be prevented effectively. As a countermeasure for this problem, the plural temperature sensors 40 are disposed in the M direction, so that the detected temperature is averaged and the difference between the actual temperature and the detected temperature is minimized. Consequently, the density unevenness can be corrected minutely than ever before.

In the embodiment shown in FIGS. 6 and 7, the flexible printed substrate is used to electrically connect the wiring pattern and the circuit pattern. However, general connectors or wire bondings may be used instead.

In the above embodiments, the thermal head used in the color thermal printer is explained. The present invention is also applicable to thermal heads in thermal-transfer type printers and dye-sublimation type printers, and moreover, to a recording head for an ink jet printer in which ink is jetted by heat of the heating element.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A recording head for recording an image on a recording material comprising:

a head substrate having heat radiation property;

an element substrate fixed to said head substrate;

plural heating elements formed on said element substrate;

at least one driver IC, attached to said element substrate, for driving and heating said heating elements;

at least one temperature sensor, attached to said element substrate, for measuring temperature near said heating elements, a heat quantity of each of said heating elements being adjusted in accordance with the measured temperature, wherein said plural heating elements are arranged linearly along a width direction crosswise to a feeding direction of said recording material, said at least one driver IC is a plurality of driver ICs arranged in said width direction, wherein said recording head is a thermal head, and wherein the recording head further comprises a capacitor, said capacitor and said at least one temperature sensor being connected in parallel to said plural heating elements, said temperature being measured by the following steps:

charging said capacitor;

discharging said capacitor to a predetermined potential through said temperature sensor; and calculating a resistance value of said temperature sensor based on time taken for discharging, said resistance value changing in accordance with temperature.

2. A recording head as claimed in claim 1, further comprising a switch for charging said capacitor and a switching element connected in series with said temperature sensor, said capacitor being charged when said switch is turned on, said capacitor starting to discharge when said switching element is turned on.

3. A recording head provided with an element substrate on whose surface plural heating elements are aligned, a circuit board on which a control circuit is mounted, a driver IC for driving said heating elements selectively, and a head substrate with heat radiation property attached to rear surfaces of said element substrate and said circuit board, said recording head comprising:

plural temperature sensors, disposed on said rear surface of said element substrate for measuring temperature near said heating element;

a wiring pattern for connecting to said temperature sensor;

a circuit pattern of said control circuit formed in both surfaces of said circuit board; and a connector, positioned between said element substrate and said circuit board, for connecting electrically said wiring pattern and said circuit pattern.

4. A recording head as claimed in claim 3, wherein said plural heating elements and said temperature sensor are arranged linearly.

5. A recording head as claimed in claim 4, wherein said temperature sensor is positioned behind said heating element.

6. A recording head as claimed in claim 5, wherein said connector is a flexible printed board.

7. A recording head as claimed in claim 6, wherein said head substrate comprises: plural recesses for accommodating said temperature sensor and said connector respectively.

8. A recording head as claimed in claim 7, wherein said temperature sensor is placed within 10 mm from a point underneath said heating element.

9. A recording head as claimed in claim 8, wherein an insulating film is applied to a position where rear surfaces of said element substrate and said circuit board contact with said head substrate.

* * * * *